US006240915B1

(12) United States Patent
Fletcher, Sr.

(10) Patent No.: US 6,240,915 B1
(45) Date of Patent: Jun. 5, 2001

(54) MOBILE FRYER AND STEAMER COOKING APPARATUS

(76) Inventor: Joe L. Fletcher, Sr., 944 Landess Cir., Madison, AL (US) 35756

( * ) Notice: Subject to any disclaimer, the term of this patent is extended or adjusted under 35 U.S.C. 154(b) by 0 days.

(21) Appl. No.: 09/636,608

(22) Filed: Aug. 11, 2000

(51) Int. Cl.[7] ..... F24C 1/16

(52) U.S. Cl. ..... 126/276; 126/25 R; 126/41 R; 99/340

(58) Field of Search ..... 126/41 R, 33, 126/276, 25 R, 25 A, 21 R; 99/427, 446, 340, 449; 296/22, 181, 24.1; 280/47.19, 47.35

(56) References Cited

U.S. PATENT DOCUMENTS

| | | | | |
|---|---|---|---|---|
| D. 291,047 | | 7/1987 | Pappas . | |
| 1,244,489 | * | 10/1917 | Gunn | 126/276 |
| 3,696,803 | * | 10/1972 | Holloway, Jr. | 126/276 |
| 3,722,498 | | 3/1973 | Kimbrough . | |
| 3,991,739 | * | 11/1976 | Hoffman, Jr. | 126/276 |
| 4,086,849 | * | 5/1978 | Simmons | 126/276 |
| 4,616,625 | | 10/1986 | Froome . | |
| 4,686,958 | | 8/1987 | Skelton et al. . | |
| 5,255,664 | * | 10/1993 | Gurliacci | 126/276 |
| 5,642,660 | | 7/1997 | Killgore et al. . | |
| 5,776,530 | | 7/1998 | Davis et al. . | |

* cited by examiner

*Primary Examiner*—James C. Yeung

(57) ABSTRACT

A mobile fryer and steamer cooking apparatus for providing a mobile outdoor multiple cooking station. The mobile fryer and steamer cooking apparatus includes a trailer assembly including wheeled axles, a frame securely mounted upon the wheeled axles, and a tongue assembly securely attached to the frame and extending forward thereof for hitching to a prime mover; and also includes a cooker assembly being securely mounted upon the frame and including a cooking support member having a peripheral wall assembly supported and extending upwardly upon the frame, and also including burners being securely disposed within the peripheral wall assembly, and further including a fuel control assembly for controlling fuel to the burners, and also including a fuel supply assembly being supported upon the frame for providing fuel to the burners, and further including cooking vessels being removably disposed upon the burners for cooking food products, and also including steamer vats being mounted to the cooking support member; and further includes a trailer stabilizing assembly being securely mounted to the tongue assembly.

17 Claims, 4 Drawing Sheets

10
39
37

29
33
13
30
31
14
40
18
40
3
25
25
3
19
19
25
25
16
15
40
40
25
25
40
19
19
25
25
41
41
21
20
17
41
20
21

39
10
13

29
31
14
12
26
26
24
25
25
26
22
23
23
22
26
25
25
15
16
24
11
25
25
22
23
23
22
26
25
25
26
26
12
24
17
21
21

MOBILE FRYER AND STEAMER COOKING APPARATUS

BACKGROUND OF THE INVENTION

1. Field of the Invention

The present invention relates to a wheeled fryer and steamer apparatus and more particularly pertains to a new mobile fryer and steamer cooking apparatus for providing a mobile outdoor multiple cooking station.

2. Description of the Prior Art

The use of a wheeled fryer and steamer apparatus is known in the prior art. More specifically, a wheeled fryer and steamer apparatus heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,722,498; U.S. Pat. No. 4,686,958; U.S. Pat. No. 4,616,625; U.S. Pat. No. Des. 291,047; U.S. Pat. No. 5,642,660; and U.S. Pat. No. 5,776,530.

While these devices fulfill their respective, particular objectives and requirements, the aforementioned patents do not disclose a new mobile fryer and steamer cooking apparatus. The inventive device includes a trailer assembly including wheeled axles, a frame securely mounted upon the wheeled axles, and a tongue assembly securely attached to the frame and extending forward thereof for hitching to a prime mover; and also includes a cooker assembly being securely mounted upon the frame and including a cooking support member having a peripheral wall assembly supported and extending upwardly upon the frame, and also including burners being securely disposed within the peripheral wall assembly, and further including a fuel control assembly for controlling fuel to the burners, and also including a fuel supply assembly being supported upon the frame for providing fuel to the burners, and further including cooking vessels being removably disposed upon the burners for cooking food products, and also including steamer vats being mounted to the cooking support member; and further includes a trailer stabilizing assembly being securely mounted to the tongue assembly.

In these respects, the mobile fryer and steamer cooking apparatus according to the present invention substantially departs from the conventional concepts and designs of the prior art, and in so doing provides an apparatus primarily developed for the purpose of providing a mobile outdoor multiple cooking station.

SUMMARY OF THE INVENTION

In view of the foregoing disadvantages inherent in the known types of wheeled fryer and steamer apparatus now present in the prior art, the present invention provides a new mobile fryer and steamer cooking apparatus construction wherein the same can be utilized for providing a mobile outdoor multiple cooking station.

The general purpose of the present invention, which will be described subsequently in greater detail, is to provide a new mobile fryer and steamer cooking apparatus which has many of the advantages of the wheeled fryer and steamer apparatus mentioned heretofore and many novel features that result in a new mobile fryer and steamer cooking apparatus which is not anticipated, rendered obvious, suggested, or even implied by any of the prior art wheeled fryer and steamer apparatus, either alone or in any combination thereof.

To attain this, the present invention generally comprises a trailer assembly including wheeled axles, a frame securely mounted upon the wheeled axles, and a tongue assembly securely attached to the frame and extending forward thereof for hitching to a prime mover; and also includes a cooker assembly being securely mounted upon the frame and including a cooking support member having a peripheral wall assembly supported and extending upwardly upon the frame, and also including burners being securely disposed within the peripheral wall assembly, and further including a fuel control assembly for controlling fuel to the burners, and also including a fuel supply assembly being supported upon the frame for providing fuel to the burners, and further including cooking vessels being removably disposed upon the burners for cooking food products, and also including steamer vats being mounted to the cooking support member; and further includes a trailer stabilizing assembly being securely mounted to the tongue assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mobile fryer and steamer cooking apparatus which has many of the advantages of the wheeled fryer and steamer apparatus mentioned heretofore and many novel features that result in a new mobile fryer and steamer cooking apparatus which is not anticipated, rendered obvious, suggested, or even implied by any of the prior art wheeled fryer and steamer apparatus, either alone or in any combination thereof.

It is another object of the present invention to provide a new mobile fryer and steamer cooking apparatus which may be easily and efficiently manufactured and marketed.

It is a further object of the present invention to provide a new mobile fryer and steamer cooking apparatus which is of a durable and reliable construction.

An even further object of the present invention is to provide a new mobile fryer and steamer cooking apparatus which is susceptible of a low cost of manufacture with regard to both materials and labor, and which accordingly is then susceptible of low prices of sale to the consuming public, thereby making such mobile fryer and steamer cooking apparatus economically available to the buying public.

Still yet another object of the present invention is to provide a new mobile fryer and steamer cooking apparatus which provides in the apparatuses and methods of the prior art some of the advantages thereof, while simultaneously overcoming some of the disadvantages normally associated therewith.

Still another object of the present invention is to provide a new mobile fryer and steamer cooking apparatus for providing a mobile outdoor multiple cooking station.

Yet another object of the present invention is to provide a new mobile fryer and steamer cooking apparatus which includes a trailer assembly including wheeled axles, a frame securely mounted upon the wheeled axles, and a tongue assembly securely attached to the frame and extending forward thereof for hitching to a prime mover; and also includes a cooker assembly being securely mounted upon the frame and including a cooking support member having a peripheral wall assembly supported and extending upwardly upon the frame, and also including burners being securely disposed within the peripheral wall assembly, and further including a fuel control assembly for controlling fuel to the burners, and also including a fuel supply assembly being supported upon the frame for providing fuel to the burners, and further including cooking vessels being removably disposed upon the burners for cooking food products, and also including steamer vats being mounted to the cooking support member; and further includes a trailer stabilizing assembly being securely mounted to the tongue assembly.

Still yet another object of the present invention is to provide a new mobile fryer and steamer cooking apparatus that is extemely easy to move and use anywhere outdoors.

Even still another object of the present invention is to provide a new mobile fryer and steamer cooking apparatus that allows the user to cook any types of foods and practically any amounts of food at the same time with the multiple easy accessible cooking compartments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
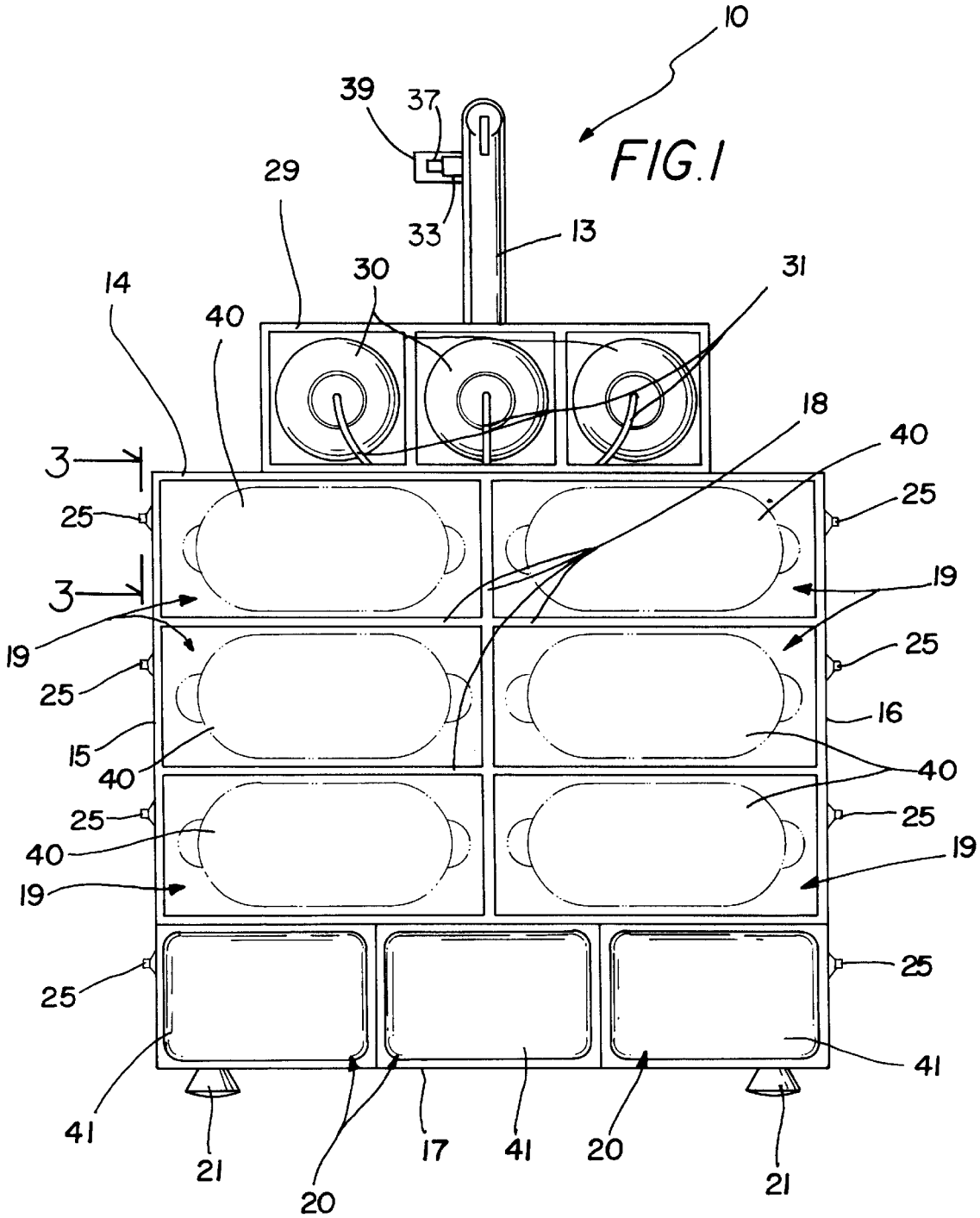
FIG. 1 is a top plan view of a new mobile fryer and steamer cooking apparatus according to the present invention.
Figure 2:
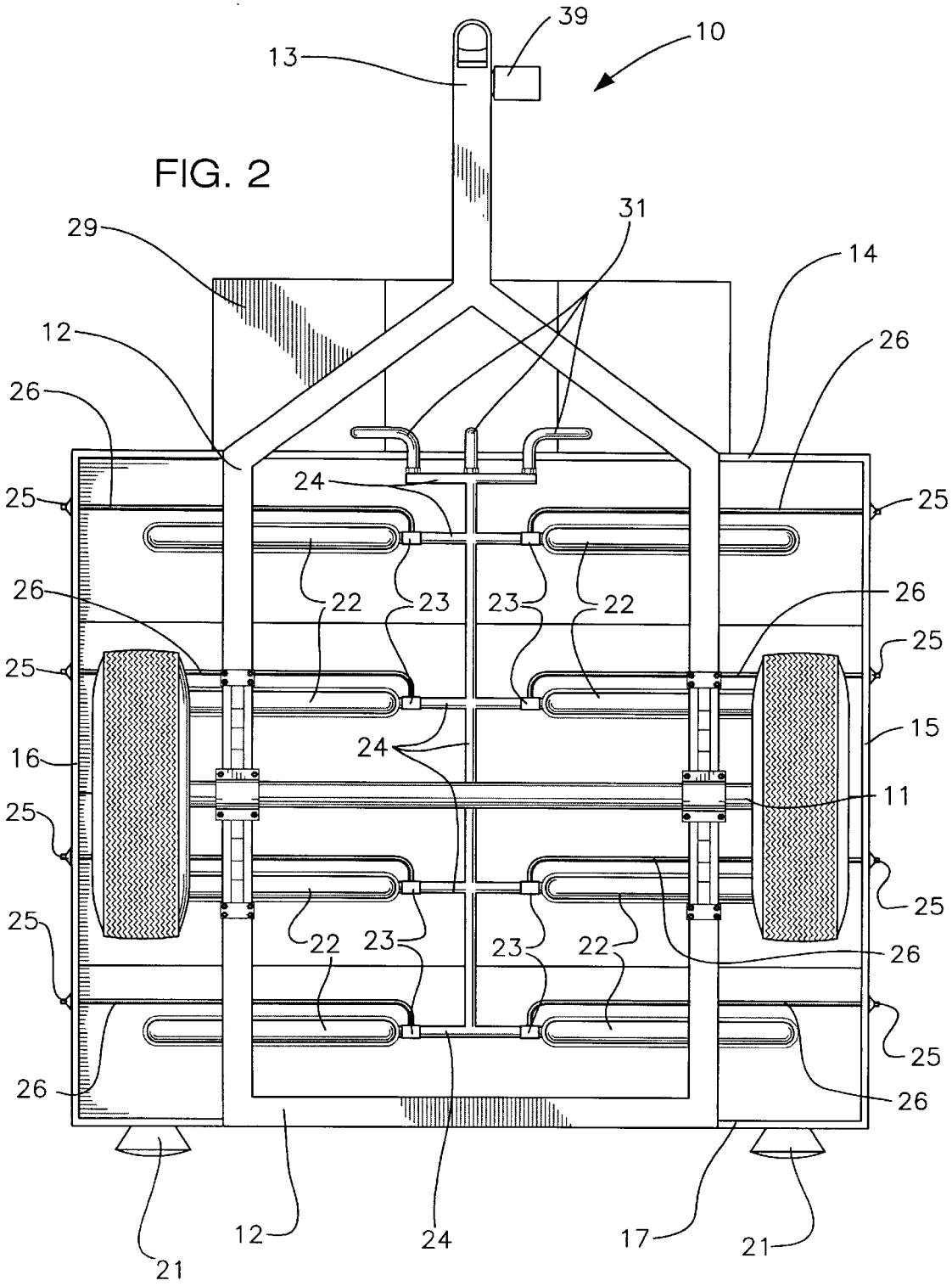
FIG. 2 is a bottom plan view of the present invention.
Figure 3:
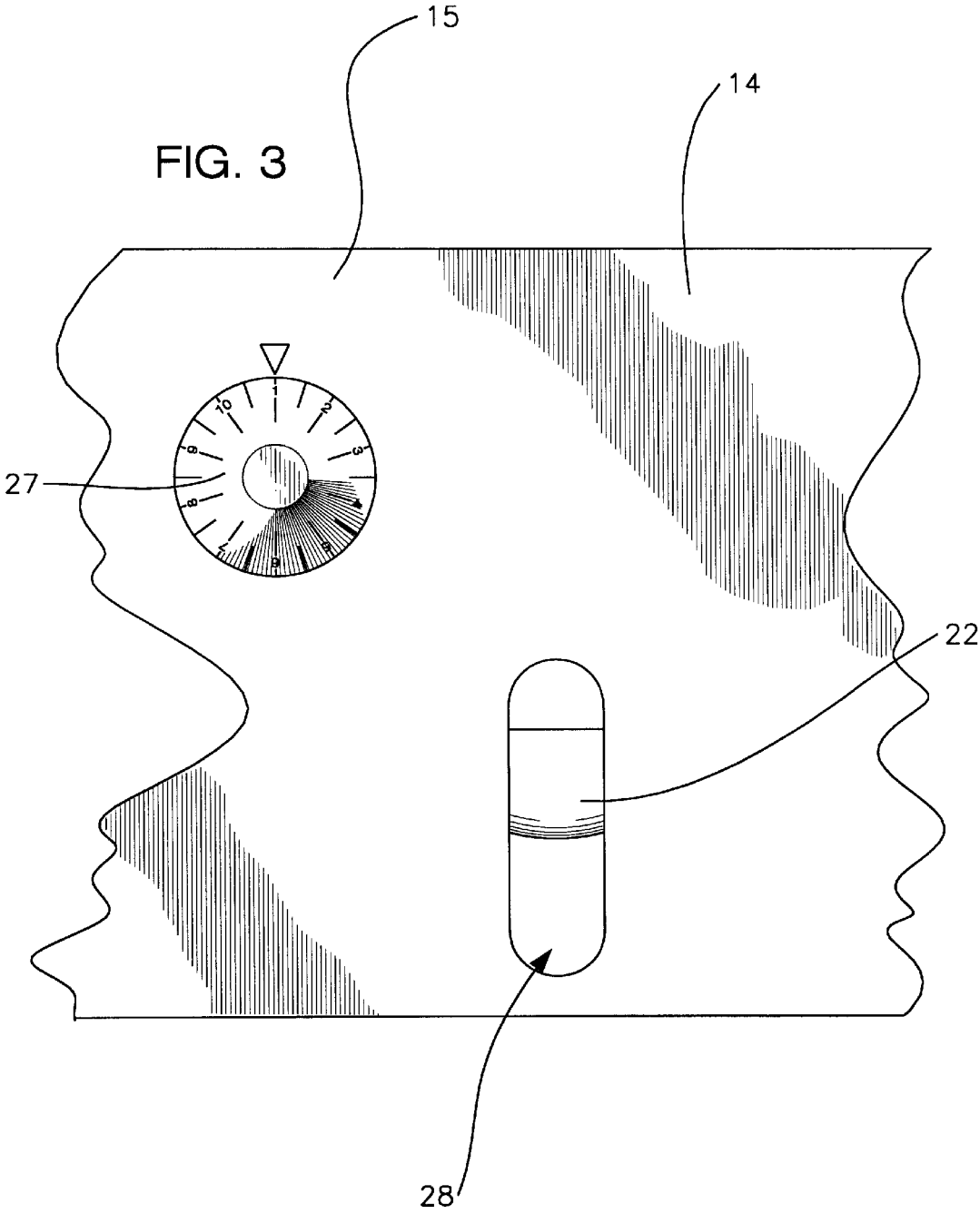
FIG. 3 is a detailed side elevational view of one of the burner lighting slots and burner control member of the present invention.
Figure 4:
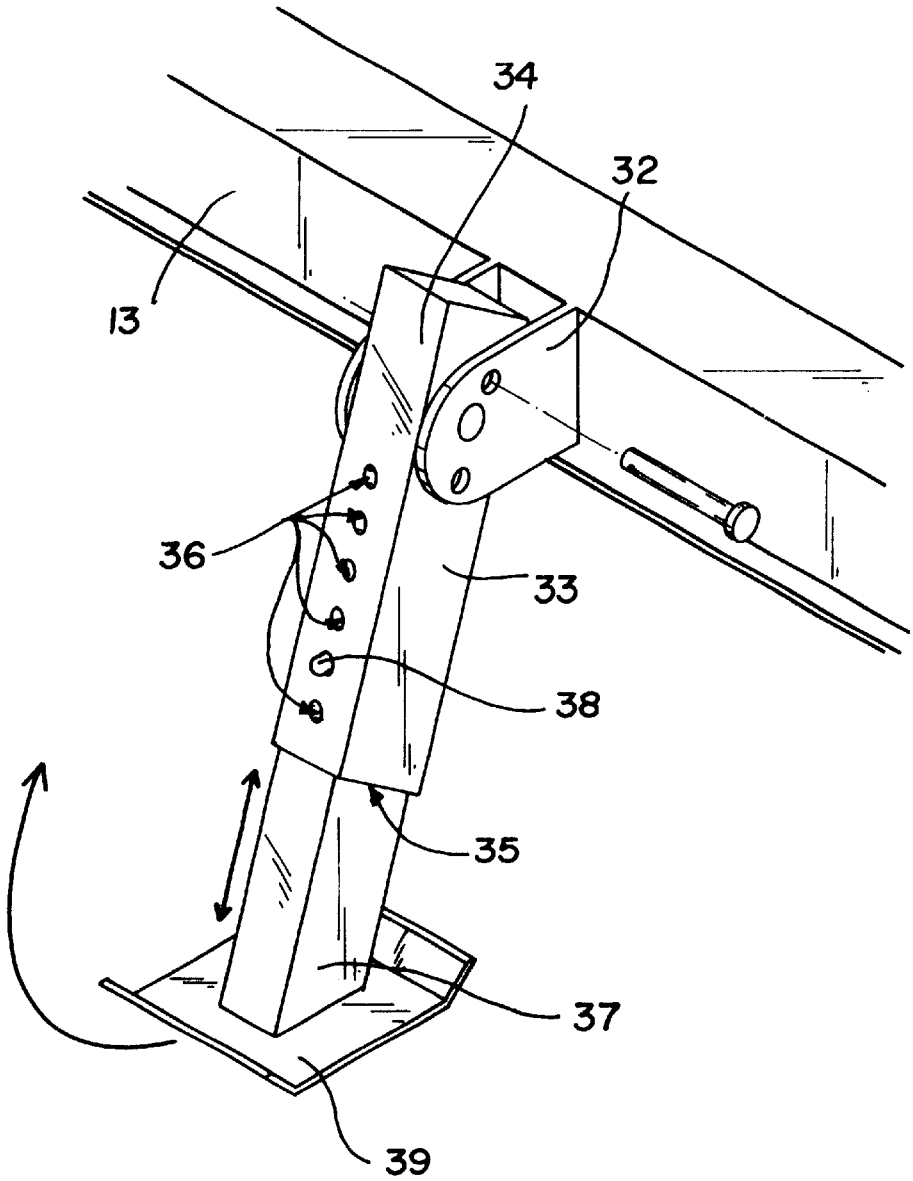
FIG. 4 is a detailed perspective view of the trailer stabilizing member of the present invention.

With reference now to the drawings, and in particular to FIGS. 1 through 4 thereof, a new mobile fryer and steamer cooking apparatus embodying the principles and concepts of the present invention and generally designated by the reference numeral 10 will be described.

As best illustrated in FIGS. 1 through 4, the mobile fryer and steamer cooking apparatus 10 generally comprises a trailer assembly including wheeled axles 11, a frame 12 securely and conventionally mounted upon the wheeled axles 1, and a tongue assembly 13 securely and integrally attached to the frame 12 and extending forward thereof for hitching to a prime mover.

A cooker assembly is securely and conventionally mounted upon the frame 12 and includes a cooking support member 14 having a peripheral wall assembly 15,16,17 supported and extending upwardly upon the frame 12, and also includes burners 22 being securely and conventionally disposed within the peripheral wall assembly 15–17, and further includes a fuel control assembly 23–28 for controlling fuel to the burners 22, and also includes a fuel supply assembly 29–31 being conventionally supported upon the frame 12 for providing fuel to the burners 22, and further includes cooking vessels 40 being removably disposed upon the burners 22 for cooking food products, and also including steamer vats 41 being mounted to the cooking support member 14. The peripheral wall assembly 15–17 includes a back wall 17 and side walls 15,16. The trailer assembly also includes tail light members 21 securely and conventionally attached to an outside of the back wall 17 of the peripheral wall assembly 15–17. The cooking support member 14 also includes partitions 18 spacedly and securely disposed between and securely and conventionally attached to the peripheral wall assembly 15–17 thus forming separated cooking compartments 19,20. Each of the burners 22 is securely disposed in a respective cooking compartment 19,20. The fuel control assembly 23–28 includes fuel control valves 23 securely and conventionally attached to the burners 22, and also includes fuel conduits 24 being securely and conventionally attached to the fuel control valves 23, and further includes fuel flow control switches 25 being securely and conventionally connected to the fuel control valves 23 with wires 26, also includes burner lighting slots 28 disposed through the side walls 15,16 for allowing a user to light each burner 22 by using a match or a lighter. The fuel supply assembly 29–31 includes a tank support member 29 being securely and conventionally mounted upon the frame 12, and also includes refillable fuel tanks 30 being removably supported upon the tank support member 29 and being conventionally connected to the fuel conduits 24 with hoses 31 for supplying fuel to the burners 22. The cooking compartments 19,20 include fryer cooking compartments 19 and steamer cooking compartments 20 with the cooking vessels 40 being essentially skillet-like pans which are adapted to be supported upon the burners 22 in the fryer cooking compartments 19 for frying food products and with the steamer vats 41 being removably and spacedly disposed upon the burners 22 in the steamer cooking compartments 20 for steaming food products. Each of the fuel flow control switches 25 includes a dial member 27 rotatably and conventionally mounted to a respective side wall 15,16 of the peripheral wall assembly 15–17.

A trailer stabilizing assembly 32–39 is securely and conventionally mounted to the tongue assembly 13. The trailer stabilizing assembly 32–39 includes a bracket member 32 securely and conventionally attached and welded to the tongue assembly 13, and also includes a tubular member 33 having a first end 34 which is pivotally attached to the bracket member 32 and also having an open second end 35 with a bore extending therein, and further includes a leg member 37 being movably disposed in and adjustably extendable from the tubular member 33 through the open second end 35, and also includes a foot member 39 being securely and conventionally attached to an end of the leg member 37 and being engageable upon a ground for stabilizing the trailer assembly. The tubular member 33 includes a plurality of holes 36 being spaced apart and disposed along and through a wall thereof. The trailer stabilizing assembly 32–39 further includes a fastening member 38 depressibly and outwardly biasedly disposed upon the leg member 37 with the fastening member 38 being receivable in any of the holes 36 to adjustably lock the leg member 37 to the tubular member 33.

In use, the user can hitch the tongue assembly 13 to a prime mover and take the mobile fryer and steamer cooking apparatus 10 to a selected area such as a park or a camp ground and light the burners 22 through the burner lighting slots 28 disposed through the side walls 15,16 of the cooking support member 14 and control the temperature of the burners 22 by adjusting the dial members 27 to the selected temperatures. The user can essentially fry foods which are usually fried and can also boil and steam foods which are usually boiled or steamed such as pasta.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mobile fryer and steamer cooking apparatus comprising:

a trailer assembly including wheeled axles, a frame securely mounted upon said wheeled axles, and a tongue assembly securely attached to said frame and extending forward thereof for hitching to a prime mover;

a cooker assembly being securely mounted upon said frame and including a cooking support member having a peripheral wall assembly supported and extending upwardly upon said frame, and also including burners being securely disposed within said peripheral wall assembly, and further including a fuel control assembly for controlling fuel to said burners, and also including a fuel supply assembly being supported upon said frame for providing fuel to said burners, and further including cooking vessels being removably disposed upon said burners for cooking food products, and also including steamer vats being mounted to said cooking support member; and a trailer stabilizing assembly being securely mounted to said tongue assembly, said trailed stabilizing assembly comprising:

a bracket member attached to said tongue assembly;

a tubular member having a first end which is pivotally attached to said bracket member and an open second end with a bore extending therein;

a leg member being movably disposed in and adjustably extendable from said tubular member through said open second end; and a foot member attached to an end of said leg member for resting on a ground surface.

2. A mobile fryer and steamer cooking apparatus as described in claim 1, wherein said peripheral wall assembly includes a back wall and side walls.

3. A mobile fryer and steamer cooking apparatus as described in claim 2, wherein said trailer assembly also includes tail light members securely attached to an outside of said back wall of said peripheral wall assembly.

4. A mobile fryer and steamer cooking apparatus as described in claim 1, wherein said cooking support member also includes partitions disposed between and securely attached to said peripheral wall assembly thus forming separated cooking compartments.

5. A mobile fryer and steamer cooking apparatus as described in claim 4, wherein each of said burners is securely disposed in a respective said cooking compartment.

6. A mobile fryer and steamer cooking apparatus as described in claim 4, wherein said cooking compartments include fryer cooking compartments and steamer cooking compartments.

7. A mobile fryer and steamer cooking apparatus as described in claim 6, wherein said cooking vessels are essentially skillet-like pans which are adapted to be supported upon said burners in said fryer cooking compartments for frying food products.

8. A mobile fryer and steamer cooking apparatus as described in claim 6, wherein said steamer vats are removably and spacedly disposed upon said burners in said steamer cooking compartments for steaming food products.

9. A mobile fryer and steamer cooking apparatus as described in claim 8, wherein said fuel control assembly includes fuel control valves securely attached to said burners, and also includes fuel conduits being securely attached to said fuel control valves, and further includes fuel flow control switches being securely connected to said fuel control valves with wires, and also includes burner lighting slots disposed through said peripheral wall assembly for allowing a user to light each said burner by using a match or a lighter.

10. A mobile fryer and steamer cooking apparatus as described in claim 9, wherein each of said fuel flow control switches includes a dial member rotatably mounted to said peripheral wall assembly.

11. A mobile fryer and steamer cooking apparatus as described in claim 1, wherein said fuel supply assembly includes a tank support member being securely mounted upon said frame, and also includes fuel tanks being removably supported upon said tank support member and being connected to said fuel conduits with hoses for supplying fuel to said burners.

12. A mobile fryer and steamer cooking apparatus as described in claim 1, wherein said tubular member includes a plurality of holes being spaced apart and disposed along and through a wall thereof.

13. A mobile fryer and steamer cooking apparatus as described in claim 12, wherein said trailer stabilizing assembly further includes a fastening member depressibly and outwardly biasedly disposed upon said leg member, said fastening member being receivable in any of said holes to adjustably lock said leg member to said tubular member.

14. A mobile fryer and steamer cooking apparatus comprising:

a trailer assembly including wheeled axles, a frame securely mounted upon said wheeled axles, and a tongue assembly securely attached to said frame and extending forward thereof for hitching to a prime mover;

a cooker assembly being securely mounted upon said frame and including a cooking support member having a peripheral wall assembly supported and extending upwardly upon said frame, and also including burners being securely disposed within said peripheral wall assembly, and further including a fuel control assembly for controlling fuel to said burners, and also including a fuel supply assembly being supported upon said frame for providing fuel to said burners, and further including cooking vessels being removably disposed upon said burners for cooking food products, and also including steamer vats being mounted to said cooking support member, said peripheral wall assembly including a back wall and side walls, said trailer assembly also including tail light members securely attached to an outside of said back wall of said peripheral wall assembly, said cooking support member also including partitions spacedly and securely disposed between and securely attached to said peripheral wall assembly thus forming separated cooking compartments, each of said burners being securely disposed in a respective said cooking compartment, said fuel control assembly including fuel control valves securely attached to said burners, and also including fuel conduits being securely attached to said fuel control valves, and further including fuel flow control switches being securely connected to said fuel control valves with wires, also including burner lighting slots disposed through said side walls for allowing a user to light each said burner by using a match or a lighter, said fuel supply assembly including a tank support member being securely mounted upon said frame, and also including fuel tanks being removably supported upon said tank support member and being connected to said fuel conduits with hoses for supplying fuel to said burners, said cooking compartments including fryer cooking compartments and steamer cooking compartments, said cooking vessels being essentially skillet-like pans which are adapted to be supported upon said burners in said fryer cooking compartments for frying food products, said steamer vats being removably and spacedly disposed upon said burners in said steamer cooking compartments for steaming food products, each of said fuel flow control switches including a dial member rotatably mounted to a respective said side wall of said peripheral wall assembly; and a trailer stabilizing assembly being securely mounted to said tongue assembly, said trailer stabilizing assembly including a bracket member securely attached to said tongue assembly, and also including a tubular member having a first end which is pivotally attached to said bracket member, and also having an open second end with a bore extending therein, and further including a leg member being movably disposed in and adjustably extendable from said tubular member through said open second end, and also including a foot member being securely attached to an end of said leg member and being engagable upon a ground, said tubular member including a plurality of holes being spaced apart and disposed along and through a wall thereof, said trailer stabilizing assembly further including a fastening member depressibly and outwardly biasedly disposed upon said leg member, said fastening member being receivable in any of said holes to adjustably lock said leg member to said tubular member.

15. A mobile fryer and steamer cooking apparatus comprising:

a trailer assembly including wheeled axles, a frame securely mounted upon said wheeled axles, and a tongue assembly securely attached to said frame and extending forward thereof for hitching to a prime mover;

a cooker assembly being securely mounted upon said frame and including a cooking support member having a peripheral wall assembly supported and extending upwardly upon said frame, and also including burners being securely disposed within said peripheral wall assembly, and further including a fuel control assembly for controlling fuel to said burners, and also including a fuel supply assembly being supported upon said frame for providing fuel to said burners, and further including cooking vessels being removably disposed upon said burners for cooking food products, and also including steamer vats being mounted to said cooking support member; and a trailer stabilizing assembly being securely mounted to said tongue assembly;

wherein said peripheral wall assembly includes a back wall and side walls;

wherein said trailer assembly also includes tail light members securely attached to an outside of said back wall of said peripheral wall assembly;

wherein said cooking support member also includes partitions spacedly and securely disposed between and securely attached to said peripheral wall assembly thus forming separated cooking compartments;

wherein each of said burners is securely disposed in a respective said cooking compartment;

wherein said fuel control assembly includes fuel control valves securely attached to said burners, and also includes fuel conduits being securely attached to said fuel control valves, and further includes fuel flow control switches being securely connected to said fuel control valves with wires, and also includes burner lighting slots disposed through said side walls for allowing a user to light each said burner by using a match or a lighter;

wherein said fuel supply assembly includes a tank support member being securely mounted upon said frame, and also includes fuel tanks being removably supported upon said tank support member and being connected to said fuel conduits with hoses for supplying fuel to said burners;

wherein said cooking compartments include fryer cooking compartments and steamer cooking compartments;

wherein said cooking vessels are essentially skillet-like pans which are adapted to be supported upon said burners in said fryer cooking compartments for frying food products;

wherein said steamer vats are removably and spacedly disposed upon said burners in said steamer cooking compartments for steaming food products;

wherein each of said fuel flow control switches includes a dial member rotatably mounted to a respective said side wall of said peripheral wall assembly; and wherein said trailer stabilizing assembly includes a bracket member securely attached to said tongue assembly, and also includes a tubular member having a first end which is pivotally attached to said bracket member and an open second end with a bore extending therein, and further includes a leg member being movably disposed in and adjustably extendable from said tubular member through said open second end, and also includes a foot member being securely attached to an end of said leg member and being engageable upon a ground.

16. A mobile fryer and steamer cooking apparatus as described in claim 15, wherein said tubular member includes a plurality of holes being spaced apart and disposed along and through a wall thereof.

17. A mobile fryer and steamer cooking apparatus as described in claim 16, wherein said trailer stabilizing assembly further includes a fastening member depressibly and outwardly biasedly disposed upon said leg member, said fastening member being receivable in any of said holes to adjustably lock said leg member to said tubular member.

* * * * *